US009025972B2

(12) United States Patent
Kosasa

(10) Patent No.: US 9,025,972 B2
(45) Date of Patent: May 5, 2015

(54) IMAGE FORMING APPARATUS HAVING TONER REPLENISHMENT UNIT

(75) Inventor: Hideaki Kosasa, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/823,926

(22) PCT Filed: Jul. 5, 2012

(86) PCT No.: PCT/JP2012/067763

§ 371 (c)(1),
(2), (4) Date: Mar. 15, 2013

(87) PCT Pub. No.: WO2013/015122

PCT Pub. Date: Jan. 31, 2013

(65) Prior Publication Data

US 2013/0170846 A1 Jul. 4, 2013

(30) Foreign Application Priority Data

Jul. 28, 2011 (JP) ..... 2011-165584

(51) Int. Cl.
*G03G 21/16* (2006.01)
*G03G 15/08* (2006.01)

(52) U.S. Cl.
CPC ..... *G03G 21/16* (2013.01); *G03G 15/0856* (2013.01); *G03G 15/0863* (2013.01); *G03G 15/087* (2013.01); *G03G 15/0879* (2013.01); *G03G 2215/0129* (2013.01); *Y10S 222/01* (2013.01)

(58) Field of Classification Search
USPC ..... 399/12, 13, 24, 27; 222/DIG. 1
See application file for complete search history.

(56) References Cited

U.S. PATENT DOCUMENTS

| | | | | |
|---|---|---|---|---|
| 6,240,262 | B1 * | 5/2001 | Taniyama et al. | 399/12 |
| 6,301,449 | B1 * | 10/2001 | Miura | 399/12 |
| 8,417,129 | B2 * | 4/2013 | Sugiura | 399/12 |
| 8,744,282 | B2 * | 6/2014 | Tsuchida | 399/12 |
| 2005/0254840 | A1 * | 11/2005 | Saisu et al. | 399/12 |
| 2008/0298820 | A1 * | 12/2008 | Sugiura | 399/12 |
| 2010/0290792 | A1 * | 11/2010 | Tsuchida | 399/12 |

FOREIGN PATENT DOCUMENTS

| | | | |
|---|---|---|---|
| JP | 6-316060 | A | 11/1994 |
| JP | 2000-137417 | A | 5/2000 |
| JP | 2005-345773 | A | 12/2005 |
| JP | 2008-203397 | A | 9/2008 |
| JP | 2008-292596 | A | 12/2008 |

OTHER PUBLICATIONS

International Search Report issued Aug. 14, 2012 for PCT/JP2012/067763.

* cited by examiner

*Primary Examiner* — David Gray
*Assistant Examiner* — Francis Gray
(74) *Attorney, Agent, or Firm* — Rossi, Kimms & McDowell LLP

(57) ABSTRACT

An image forming apparatus capable of reading a unique pattern of a toner bottle without using an expensive device, and of preventing the delay of the toner replenishment. A control unit controls a driving unit to rotate a toner bottle for replenishing toner and controls a reading unit to read a unique pattern of the toner bottle in conjunction with the rotation of the toner bottle, when receiving a toner replenishment signal in N-th time from a toner remaining amount detection unit after receiving the bottle detection signal from a bottle mounting detection unit.

4 Claims, 9 Drawing Sheets

IMAGE FORMING APPARATUS HAVING TONER REPLENISHMENT UNIT

TECHNICAL FIELD

The present invention relates to an image forming apparatus equipped with a toner replenishing device that reads unique information of a toner bottle set to the toner bottle set in a usage state.

BACKGROUND ART

In recent years, a system that ships consumables for exchange automatically to a user by automatically transmitting operating conditions of the consumables of an image forming apparatus that is connected to a network in order to increase efficiency has been proposed. In the system, the operating conditions of consumables are determined by whether new consumables were equipped.

The image forming apparatuses that constitute such a system are provided with the following configurations in order to give unique information to consumables and to read the information.

For example, PTL 1 discloses a configuration in which a container-information reading means (an image sensor) reads container information displayed by a unique pattern, such as characters, a mark, a bar code, applied to the container at a predetermined home position.

An image forming apparatus using a toner replenishing mechanism disclosed in PTL 2 reads a unique pattern (a bar code) attached to a toner bottle when the toner bottle is rotated in a direction opposite to the direction at the time of toner replenishment.

PTL 3 discloses an image formation cartridge as a consumable for exchange to which a cartridge IC tag, which performs non-contact data exchange with a body-side communication control means, is attached. The system of PTL 3 automatically orders an additional cartridge when the image formation cartridge is detached from the body of the apparatus.

However, since the configuration of the PTL 1 or PTL 3 uses the expensive image sensor or the IC tag for reading the container information, a product price becomes expensive. In the configuration of PTL 2, the toner cannot be replenished until the unique information of the bottle has been read, which delays the toner replenishment.

CITATION LIST

Patent Literature

PTL 1: Japanese Laid-Open Patent Publication (Kokai) No. 1-106-316060 (JP 1994-316060A)

PTL 2: Japanese Laid-Open Patent Publication (Kokai) No. 2005-345773 (JP 2005-235773A)

PTL 3: Japanese Laid-Open Patent Publication (Kokai) No. 2008-203397 (JP 2008-203397A)

SUMMARY OF INVENTION

Technical Problem

The present invention aims to provide an image forming apparatus that is capable of reading a unique pattern of a toner bottle without using an expensive image sensor and IC tag, and of preventing the delay of the toner replenishment by eliminating the excessive operation for reading the unique pattern.

Solution to Problem

Accordingly, an aspect of the present invention provides An image forming apparatus comprising a toner replenishment unit to which a toner bottle containing toner is mounted detachably, a bottle mounting detection means that gives a bottle detection signal when detecting a mounting of the toner bottle, a rotational driving means that rotates the toner bottle in order to replenish the toner into the toner replenishment unit, a reading means that reads a unique pattern attached onto an outer surface of the toner bottle in conjunction with the rotation of the toner bottle, a toner remaining amount detection means that gives a toner replenishment signal when detecting a state where the amount of toner in the toner replenishment unit reaches a toner empty detection level that needs to replenish the toner; and a control means that receives the bottle detection signal and the toner replenishment signal from the bottle mounting detection means and the toner remaining amount detection means, respectively, and controls the rotational driving means and the reading means. The control means controls the rotational driving means to rotate the toner bottle for replenishing the toner and controls the reading means to read the unique pattern of the toner bottle in conjunction with the rotation of the toner bottle, when receiving the toner replenishment signal in N-th time (N is integer no less than 1) from the toner remaining amount detection means after receiving the bottle detection signal from the bottle mounting detection means.

Advantageous Effects of Invention

According to the present invention, since the unique pattern of the toner bottle can be read in conjunction with the operation according to the toner replenishment sequence, the unique pattern can be read without using an expensive image sensor or an IC tag. Since the present invention can eliminate the excessive operation such as a reverse rotation only for reading the unique pattern after exchanging the toner bottle, an image forming operation can be started immediately after exchanging the toner bottle.

Further features of the present invention will become apparent from the following description of exemplary embodiments with reference to the attached drawings.

DESCRIPTION OF EMBODIMENTS

Figure 1:
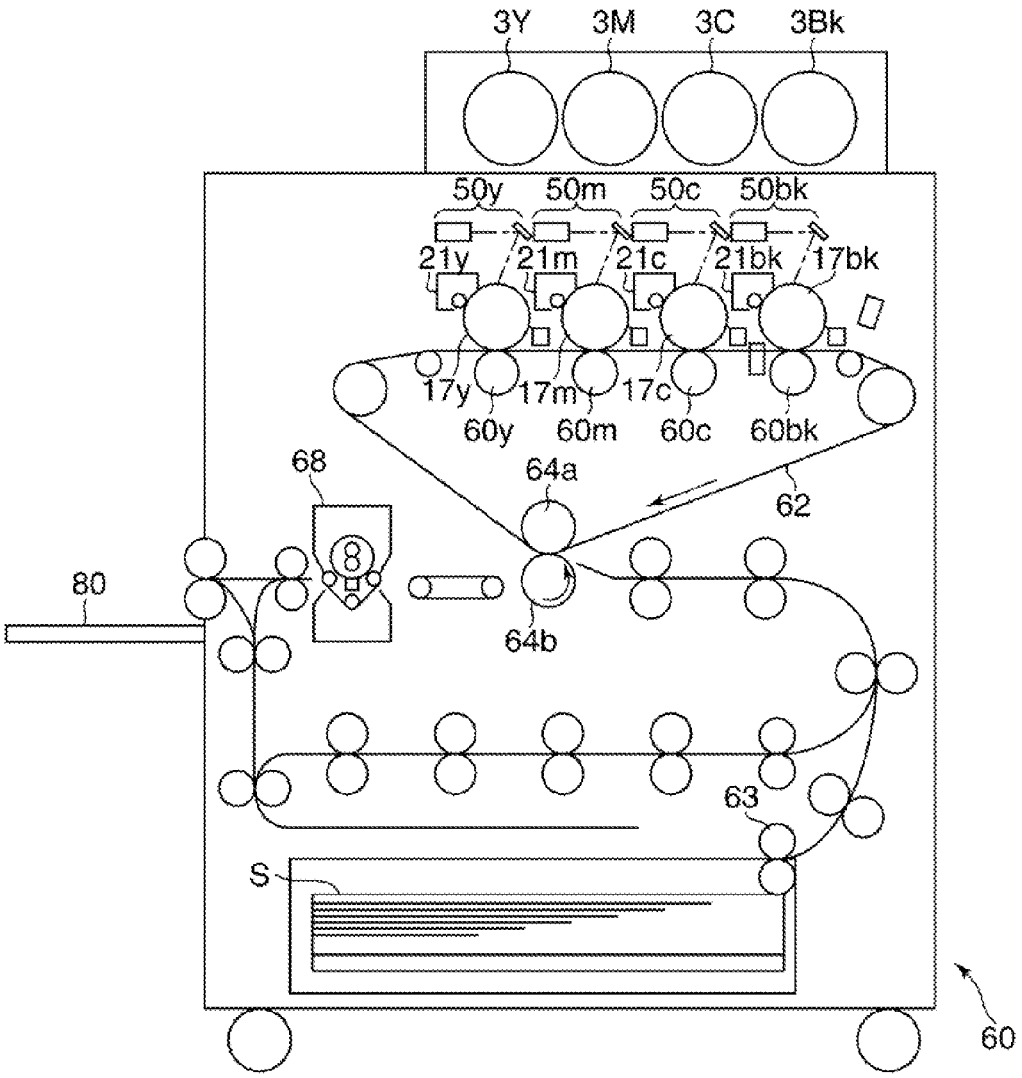
FIG. 1 is a view schematically showing a configuration of a four-color image forming apparatus with an electrophotography system according to a first embodiment of the present invention.

Hereafter, embodiments according to the present invention will be described with reference to the attached drawings. FIG. 1 is a view schematically showing a configuration of a four-color image forming apparatus with an electrophotography system according to a first embodiment. An image forming apparatus 60 employs what is called a middle transfer tandem system in which image forming units for four colors are arranged side by side over an intermediate transfer belt.

The image forming apparatus 60 forms electrostatic latent images on photoconductive drums 17*y*, 17*m*, 17*c*, and 17*bk* by exposure devices 50*y*, 50*m*, 50*c*, and 50*bk* based on print data, develops the formed electrostatic images by development devices 21*y*, 21*m*, 21*c*, and 21*bk* in order to form toner images of four colors (Yellow, Magenta, Cyan, Black).

The image forming apparatus 60 transfers the toner images onto the intermediate transfer belt 62 by primary transfer devices 60*y*, 60*m*, 60*c*, and 60*bk*, and transfers them onto a sheet S supplied from a sheet feeding device 63 by secondary transfer devices 64*a* and 64*b*. Next, the image forming apparatus 60 ejects the sheet to a sheet ejection tray 80 after fixing the transferred toner images to the sheet S by a fixing unit 68.

The image forming apparatus 60 uses removable toner bottles 3Y, 3M, 3C, and 3Bk in order to replenish toner to the development devices. Since all the toner bottles 3Y, 3M, 3C, and 3Bk have identical configurations, they are collectively indicated by the reference numeral 3 when it is not necessary to distinguish them, in the following description. Similarly, the photoconductive drums 17*y*, 17*m*, 17*c*, and 17*bk* are collectively indicated by the reference numeral 17, and the development devices 21*y*, 21*m*, 21*c*, and 21*bk* are collectively indicated by the reference numeral 21.

Next, a toner replenishment unit of the image forming apparatus 60 will be described with reference to FIG. 2. A toner supply part 2 is arranged in an upper part of the toner replenishment unit 1 that replenishes the toner to the development device 21 with which the image forming apparatus 60 is equipped. The toner supply part 2 is equipped with the toner bottle 3 for supplying toner removably. The toner replenishment unit 1 is provided with guide members 4*a* and 4*b* at sides of the toner supply part 2 so as to support the toner bottle 3 horizontally and rotatably. The toner supplied to the toner supply part 2 from the toner bottle 3 is supplied to the development device 21 via an outlet 11 formed in the toner replenishment unit 1.

The toner bottle 3 has a cylindrical container part 3*b* that forms a toner chamber, and an opening part 3*a* that has a toner outlet 5 at one side. Spiral projected rims 6 are formed on the inner circumferential surface of the container part 3*b* of the toner bottle 3 so that the rotation of the toner bottle 3 conveys the accommodated toner toward the toner outlet 5. The opening part 3*a* is closed with a seal part 7*b* of a cap member 7 when the toner bottle 3 is not mounted to the toner replenishment unit 1 so that the toner may not leak from the toner bottle 3.

The toner replenishment unit 1 is provided with a moving mechanism 8 for moving the cap member 7. When the toner bottle 3*a* is mounted to a specified position, a bottle drive motor 9 rotates in a first rotation direction, and a chuck part 8*a* of the moving mechanism 8 moves forward and backward in the direction of arrow A. During this movement, the chuck part 8*a* fits in with a fitting part 7*a* of the cap member 7, detaches the cap member 7 from the opening part 3*a*, and moves the cap member 7 to a position where the toner supply part 2 connects to the toner outlet 5.

The cap member 7 and the moving mechanism 8 are rotated as one piece in the fit-in state by the bottle drive motor 9. The cap member 7 and the moving mechanism 8 are constituted so that the toner accommodated in the toner bottle 3 is conveyed toward the toner outlet 5 when the bottle drive motor 9 rotates in the second rotation direction opposite to the first rotation direction.

The rotation of the toner bottle 3 conveys the toner accommodated in the bottle with a screw function of the spiral projected rims 6 formed on the inner circumferential surface of the toner bottle 3, and ejects the toner from the outlet 5. The toner ejection operation of the toner bottle 3 gradually supplies the toner to the toner replenishment unit 1 from the toner supply part 2. The toner supply part 2 is provided with a toner level sensor 10 that functions as a toner remaining amount detection means that gives a toner replenishment signal when detecting a state where the amount of toner in the toner replenishment unit 1 reaches a toner empty detection level that needs to replenish the toner. The toner level sensor 10 gives a toner replenishment stop signal when detecting a state where the amount of toner in the toner replenishment unit 1 reaches a toner available detection level that is sufficient to use. The toner level sensor 10 is used for controlling the amount of toner in the toner supply part 2 to be in the specified amount.

Figure 3:
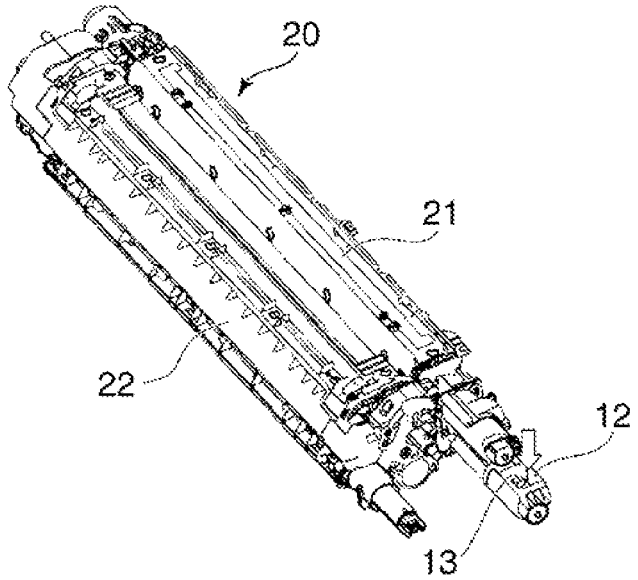
FIG. 3 is a perspective view showing a process cartridge in the image forming apparatus according to the first embodiment.

Thus, the toner replenished to the toner replenishment unit 1 is supplied to the development cartridge 21 through a toner replenishment opening 12 of the process cartridge 20 shown in FIG. 3 from the outlet 11.

Figure 4:
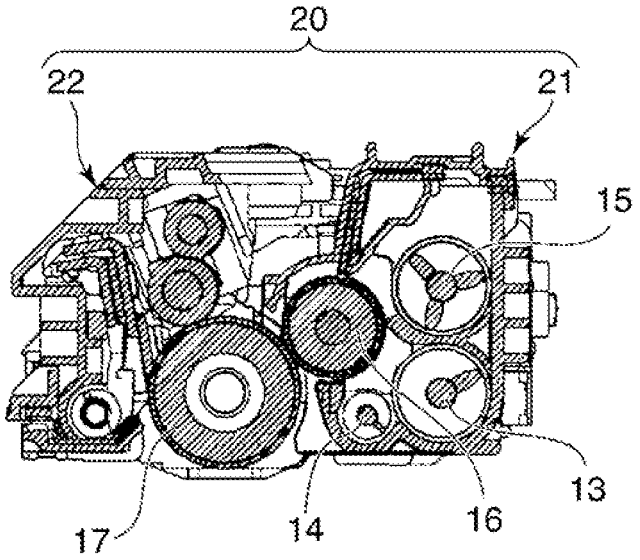
FIG. 4 is a sectional view of the process cartridge in the image forming apparatus according to the first embodiment.

The process cartridge 20 comprises a drum cartridge 22 and the development cartridge 21, as shown in the sectional view in FIG. 4. The toner supplied to the toner replenishment opening 12 of the process cartridge 20 is conveyed and circulated by toner conveyance screws 13, 14, and 15, and is supplied to a developing roller 16 that faces to the photosensitive drum 17 as a latent image bearing member.

Next, a positional relationship between a toner bottle detection unit with which the image forming apparatus is equipped and the toner bottle will be described with reference to FIG. 5A that is a side view seen in a rotation axis direction and FIG. 5B that is a front view seen in a direction perpendicular to the rotation axis.

A one-dimensional bar code label 31 is stuck on the outer peripheral part of the toner bottle 3 along the rotation direction. The bar code on the one-dimensional bar code label 31 is a unique pattern that indicates a unique ID of the toner bottle.

An ID pattern detection sensor 30 is fixed and arranged at an adjacent position that faces to the one-dimensional bar code label 31 on the toner bottle 3 in order to read the bar code. The ID pattern detection sensor 30 is a reflection type reading means that comprises a light emitting device consisting of an LED and a photo detector consisting of a photo transistor.

Figure 6:
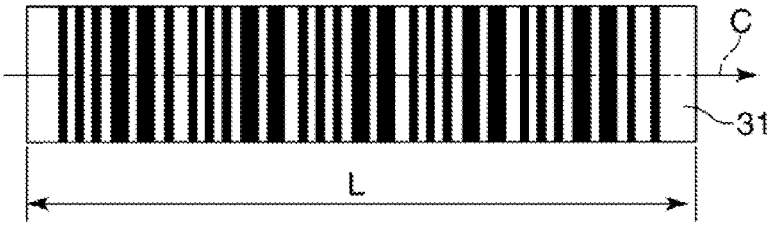
FIG. 6 is a front view showing a bar code attached to the process cartridge of the image forming apparatus according to the first embodiment.

The light amount of the LED of the ID pattern detection sensor 30 has been corrected beforehand so that an output difference between a white part and a black part of a bar code becomes larger than a predetermined value. Therefore, the ID pattern detection sensor 30 can read the edges of the bars of the bar code, and can read the length L (see FIG. 6) of the bar code the pattern of the combination of the white and black parts certainly. The ID pattern detection sensor 30 reads a one-dimensional bar code by scanning it as shown by an arrow C in FIG. 6 in conjunction with the rotation of the toner bottle 3 during the toner replenishment after mounting the toner bottle 3.

Next, a control system of the image forming apparatus according to the first embodiment will be described with reference to a block diagram in FIG. 7.

In the image forming apparatus 60, a CPU 100 as a control means executes a program stored in a ROM 101 to control the bottle drive motor 9 for a rotation and inserting/removing actions of the toner bottle 3, and to display information on the display unit 104. It should be noted that the CPU 100 is connected to a RAM 102 and a nonvolatile memory 103 in FIG. 7.

Figure 5A:
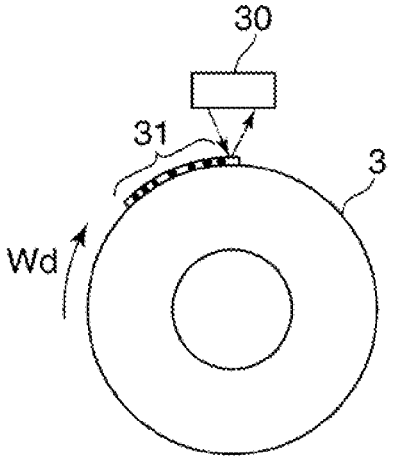
FIG. 5A is a side view showing a positional relationship between a toner bottle detection unit and a toner bottle in the image forming apparatus according to the first embodiment.
Figure 5B:
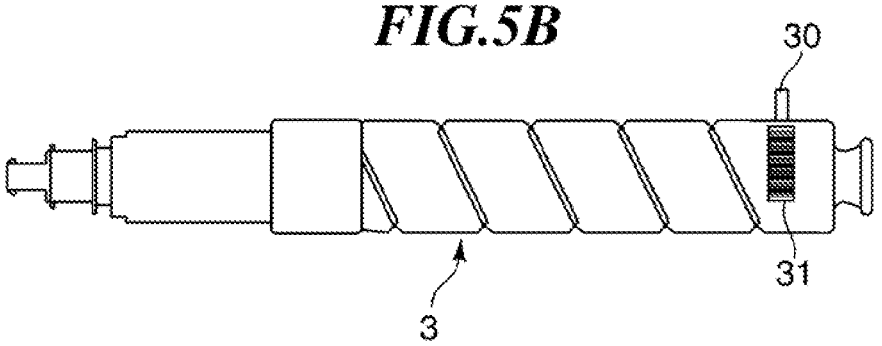
FIG. 5B is a front view showing the positional relationship between the toner bottle detection unit and the toner bottle in the image forming apparatus according to the first embodiment.

The CPU 100 controls the bottle drive motor 9 by a control operation for the toner replenishment so that the toner bottle 3 rotates in a direction Wd (the second rotation direction) shown in FIG. 5A, and replenishes the toner from the toner bottle 3. The CPU 100 rotates the bottle drive motor 9 in the opposite direction (the first rotation direction) so as to open and close the cap member 7 of the toner bottle 3.

After reading the bar code of the toner bottle, the CPU 100 stores the unique ID indicated by the read bar code in relation to the unique information about the main part of the image forming apparatus into the nonvolatile memory 103. Specifically, color information about the toner, new reading time, mounting history, a sheet number counter, a model, a machine number, destination information, etc. are stored in relation to the unique ID.

In the image forming apparatus 60, a toner bottle in use may be detached with remaining toner therein after the toner bottle is mounted and a unique ID thereof is stored in the memory, and then the toner bottle may be mounted again. In such a case, the CPU 100 controls so as to count up the mounting history only and to overwrite.

The CPU 100 is connected to a LAN 106, the Internet 107, and an inventory control system server 108 via a LAN interface unit 105. Then, the CPU 100 properly transmits the data including the read unique ID of the toner bottle and the information about the main part of the image forming apparatus to the inventory control system server 108.

When receiving the data including the unique ID, the inventory control system server 108 determines that a new toner bottle has been mounted to the image forming apparatus 60 based on the unique ID. When determining that the new toner bottle has been mounted, the inventory control system server 108 ships a toner bottle automatically.

Figure 8:
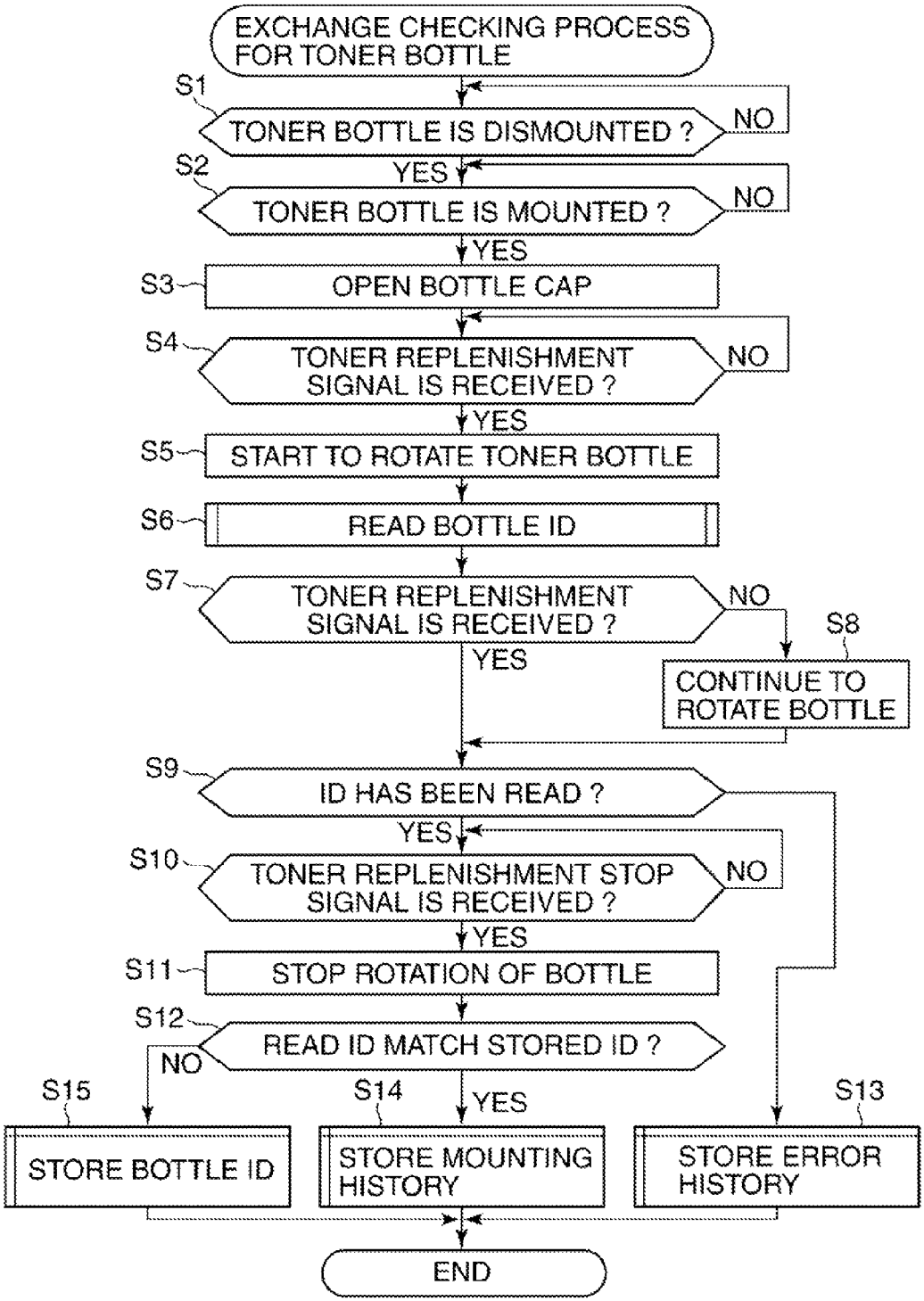
FIG. 8 is a flowchart showing an exchange checking process for a toner bottle in the image forming apparatus according to the first embodiment.

Next, an exchange checking process for a toner bottle executed by the CPU 100 in the image forming apparatus so as to supply toner continuously while exchanging a toner bottle will be described with reference to a flowchart in FIG. 8.

In the image forming apparatus 60 starts the exchange checking process for a toner bottle when the main part of the image forming apparatus is installed in a service place. Then, when detecting that the remaining amount of toner in the toner replenishment unit 1 in the image forming apparatus 60 decreases by the toner level sensor 10, the CPU 100 controls so that the toner is supplied from the toner bottle 3. Therefore, the CPU 100 drives the bottle drive motor 9 to rotate the toner bottle 3 so that the toner accommodated in the toner bottle 3 is supplied to the toner supply part 2 in order to supply the toner to the toner replenishment unit 1 from the toner bottle 3.

Here, when the toner level sensor 10 does not detect the toner even if the toner bottle 3 is rotated in the predetermined time, the CPU 100 determines that the mounted toner bottle 3 becomes empty and is needed to be exchanged for a new toner bottle. Then, when determining that the exchange for a new toner bottle is needed, the CPU 100 displays a toner bottle exchange message that urges to exchange the toner bottle 3 to the display unit 104. At the same time, the CPU 100 starts the exchange confirming process for a toner bottle (an ID reading process for a toner bottle).

When the exchange checking process for a toner bottle is started, the CPU 100 waits until the toner bottle 3 is dismounted (NO in step S1) according to the toner bottle exchange message displayed on the display unit 104. When determining that the toner bottle 3 is dismounted (YES in the step S1), the CPU 100 waits until a new toner bottle 3 in which the toner is filled is mounted (NO in step S2).

Next, when a user performs a mounting operation for the new toner bottle 3 (insertion to a mounting detection location), the CPU 100 detects wearing of the toner bottle 3 by a bottle mounting detection sensor 70 (FIG. 7) mentioned later. The bottle mounting detection sensor 70 functions as a bottle mounting detection means that gives a bottle detection signal when detecting that the toner bottle 3 is mounted. When receiving the bottle detection signal because the new toner bottle 3 is mounted (YES in the step S2), the CPU 100 drives the bottle drive motor 9 in the direction that moves the cap member 7 to an open position shown in FIG. 2 (step S3). It should be noted that the direction that moves the cap member 7 to the open position shown in FIG. 2 is a first rotation direction that is opposite to a direction that rotates the toner bottle.

Next, the CPU 100 waits until receiving a toner replenishment signal from the toner level sensor 10 that functions as a toner remaining amount detection means (NO in the step S4). And when receiving the toner replenishment signal from the toner level sensor 10 (YES in the step S4), the CPU 100 controls and drives the bottle drive motor 9 to rotate the toner bottle 3. Thereby, the toner bottle 3 rotates and the toner accommodated in the bottle is replenished to the toner replenishment unit 1 through the toner supply part 2 (step S5).

Next, the CPU 100 makes the ID pattern detection sensor 30 read a bar code of the barcode label 31 affixed on the outer circumferential surface of the toner bottle 3. Then, the CPU 100 compares the detection result of the read bar code with bar pattern string conversion data that has been stored in the RAM 102 beforehand, and converts the bar code into the unique ID number of the toner bottle 3 (step S6). It should be noted that the CPU 100 continues driving the bottle drive motor 9 to rotate the bottle (step S8), even if the toner replenishment signal is no longer outputted from the toner level sensor 10 while reading the unique ID (NO in the step S7).

Next, the CPU 100 determines whether the unique ID has been read after rotating the toner bottle 3 during predetermined time for reading the bar code (step S9). And when determining that the unique ID has been read (YES in the step S9), the CPU 100 proceeds with the process to step S10. Furthermore, the CPU 100 waits until receiving a toner replenishment stop signal from the toner level sensor 10 (NO in the step S10). When receiving the toner replenishment stop signal (YES in the step S10), the CPU 100 stops the bottle drive motor 9 (step S11) to stop the rotation of the bottle, and proceeds with the process to step S12.

On the other hand, when determining that the unique ID has not been read due to a defect of the bar code etc. (NO in the step S9), the CPU 100 proceeds with the process to step S13. In the step S13, the CPU 100 stores an error history showing that the unique ID cannot be read and a mounting history (the number and date/time of bottle dismounting/mounting operations) to the nonvolatile memory 103, and finishes this process.

Next, the CPU 100 determines whether the unique ID obtained in the step S6 matches an ID number that has been memorized in the nonvolatile memory 103 in the step S12. When determining to be matched (YES in the step S12), the CPU 100 proceeds with the process to step S14. When determining not to be matched (NO in the step S12), the CPU 100 proceeds with the process to step S15.

In the step 14, the CPU 100 specifies the data of the ID number that matches the unique ID read in the step S6 from among the ID numbers stored in the nonvolatile memory 103. Then, the CPU 100 overwrites only the mounting history (the number and date/time of bottle dismounting/mounting operations) on the data of the matched ID number, and finishes the exchange checking process for the toner bottle.

Moreover, the CPU 100 stores the unique ID read in the step S6 and the main body information associated with the unique ID to the nonvolatile memory 103 in the step S15, and finishes the exchange checking process for the toner bottle. It should be noted that the main body information includes toner color information, new reading time, a mounting history, a sheet number counter, a machine type, a machine number, and destination information.

Next, a condition that prevents over-supply of toner during the operation to read the unique ID of the toner bottle 3 in the image forming apparatus according to the first embodiment will be described with reference to FIG. 9 and FIG. 10.

Figure 9:
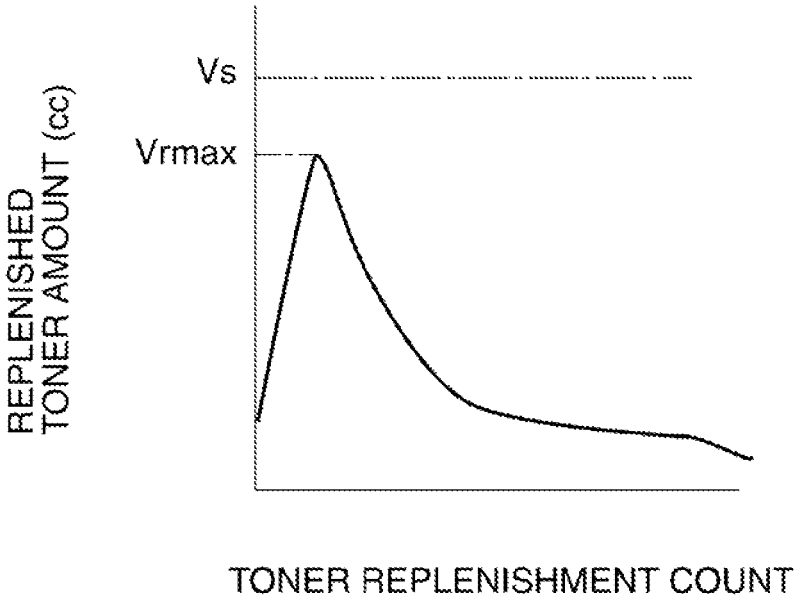
FIG. 9 is a graph showing an example of a state of the toner replenishing amount during the toner bottle detection control process in the image forming apparatus according to the first embodiment.
Figure 10:
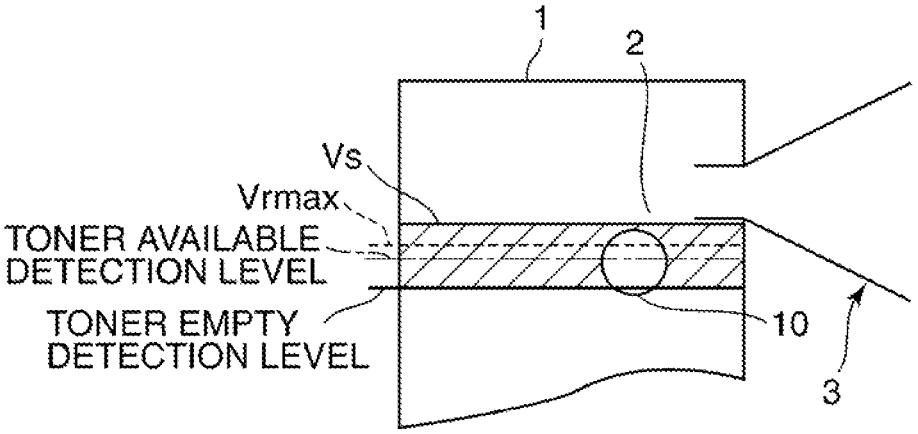
FIG. 10 is a view schematically showing a state of the amount of toner in the toner replenishment unit of the image forming apparatus according to the first embodiment.

FIG. 9 is a graph showing an example of a state of the toner replenishing amount during the toner bottle detection control process in the first embodiment. FIG. 10 is a view schematically showing a state of the amount of toner in the toner replenishment unit 1 of the image forming apparatus according to the first embodiment. In FIG. 9 and FIG. 10, "Vrmax" is the maximum toner replenishing amount corresponding to the maximum bottle rotation "Lrmax" for reading a bar code, and "Vs" is toner amount that can be accepted by the toner replenishment unit 1 when the toner replenishment signal is given.

The image forming apparatus according to the first embodiment is configured so that the toner replenishing amount from the toner bottle 3 becomes proper.

Accordingly, the toner replenishment unit 1, the toner level sensor 10, and the length L of the barcode label 31 are set up so that the toner replenishing amount satisfies the following conditional expressions at worst. "Lr" is a rotation when the toner is replenished.

$$Lrmax<Lr, \text{ or}$$

$$Lrmax>Lr \text{ and } Vrmax<Vs$$

In the image forming apparatus constituted in this way, the toner bottle 3 is rotated at a predetermined angle in order to read the ID number of the toner bottle 3. At this time, the toner is supplied from the toner bottle 3 with the rotation of the toner bottle 3. The image forming apparatus that is constituted so as to satisfy the above-mentioned conditional expressions is able to prevent the over-supply of the toner beyond a limit. For this reason, the image forming apparatus does not need to change the toner replenishment sequence in order to perform the ID pattern detection control.

In general, an image forming apparatus has a problem of overflow of over-supplied toner when a toner bottle is dismounted halfway (the bottle is dismounted under the condition where the toner remains in the toner bottle).

However, the image forming apparatus according to the first embodiment is designed so that the over-supplied toner in the toner replenishment unit 1 does not overflow from an opening 40 of a mount for the toner bottle 3 in the toner replenishment unit 1 when the toner bottle is dismounted halfway.

Figure 14A:
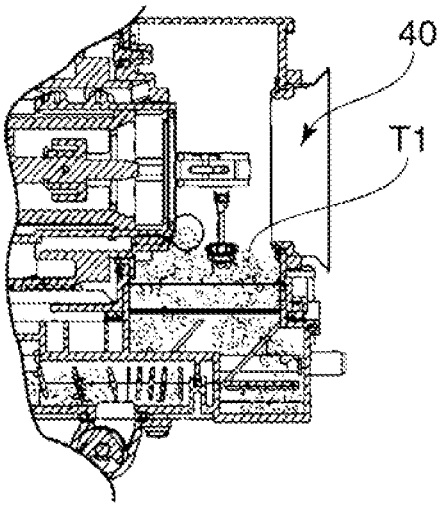
FIG. 14A is a sectional view showing a state of toner replenishment near an opening of a toner bottle mount of the image forming apparatus to which the present invention is applied.
Figure 14B:
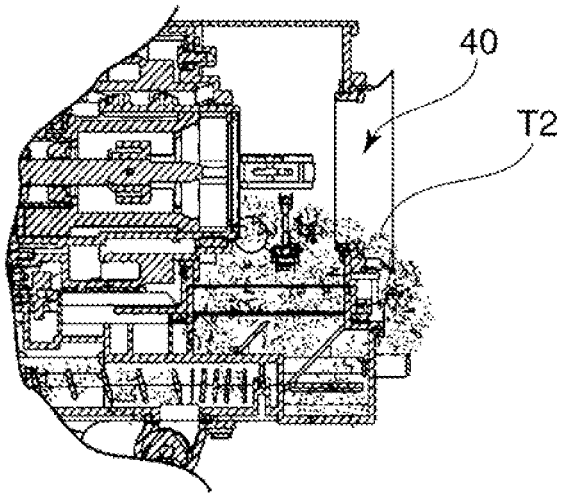
FIG. 14B is a sectional view showing a state of over-replenishment of toner near an opening of a toner bottle mount of an image forming apparatus of a comparative example to which the present invention is not applied.

An effect of such a configuration is understood by comparing a state of the image forming apparatus according to the first embodiment shown in FIG. 14A and a state of an image forming apparatus of a comparative example that has a conventional configuration shown in FIG. 14B, for example. FIG. 14A and FIG. 14B show the states of the supplied toner (T1, T2) near the opening 40 of the mount for the toner bottle, respectively. In the case of the image forming apparatus according to the first embodiment shown in FIG. 14A, the toner does not overflow from the opening 40 of the mount for the toner bottle 3. However, in the case of the image forming apparatus concerning the comparative example shown in FIG. 14B, the toner overflows from the opening 40 of the mount for the toner bottle 3.

Moreover, in the image forming apparatus concerning the first embodiment, since the toner exists in the development cartridge 21 and the toner replenishment unit 1 when the toner bottle 3 is dismounted halfway, it is not necessary to stop the image formation process immediately. However, if the image forming apparatus continues the image formation process for a long time after dismounting the toner bottle, the toner becomes insufficient. Therefore, in the image forming apparatus of the first embodiment, the CPU 100 controls the image forming apparatus to permit the image formation for the predetermined number of sheets after dismounting the toner bottle halfway, and to stop after the image formation for the predetermined number of sheets.

Although the image forming apparatus according to the first embodiment is provided with the toner replenishment unit between the toner bottle and the development cartridge, the present invention can be applied to a configuration where the toner is directly supplied to the development cartridge from the toner bottle. In that case, a buffer capacity (Vbs) at the time of receiving the toner supply by the toner conveyance means (the toner conveyance screw 13) shown in FIG. 3 is necessary to satisfy the condition Vbs>Vrmax. Moreover, although the first embodiment expresses the unique pattern of the bottle by the bar code on the barcode label, a bar code pattern may be directly inscribed on the toner bottle by a laser marking press.

Figure 11:
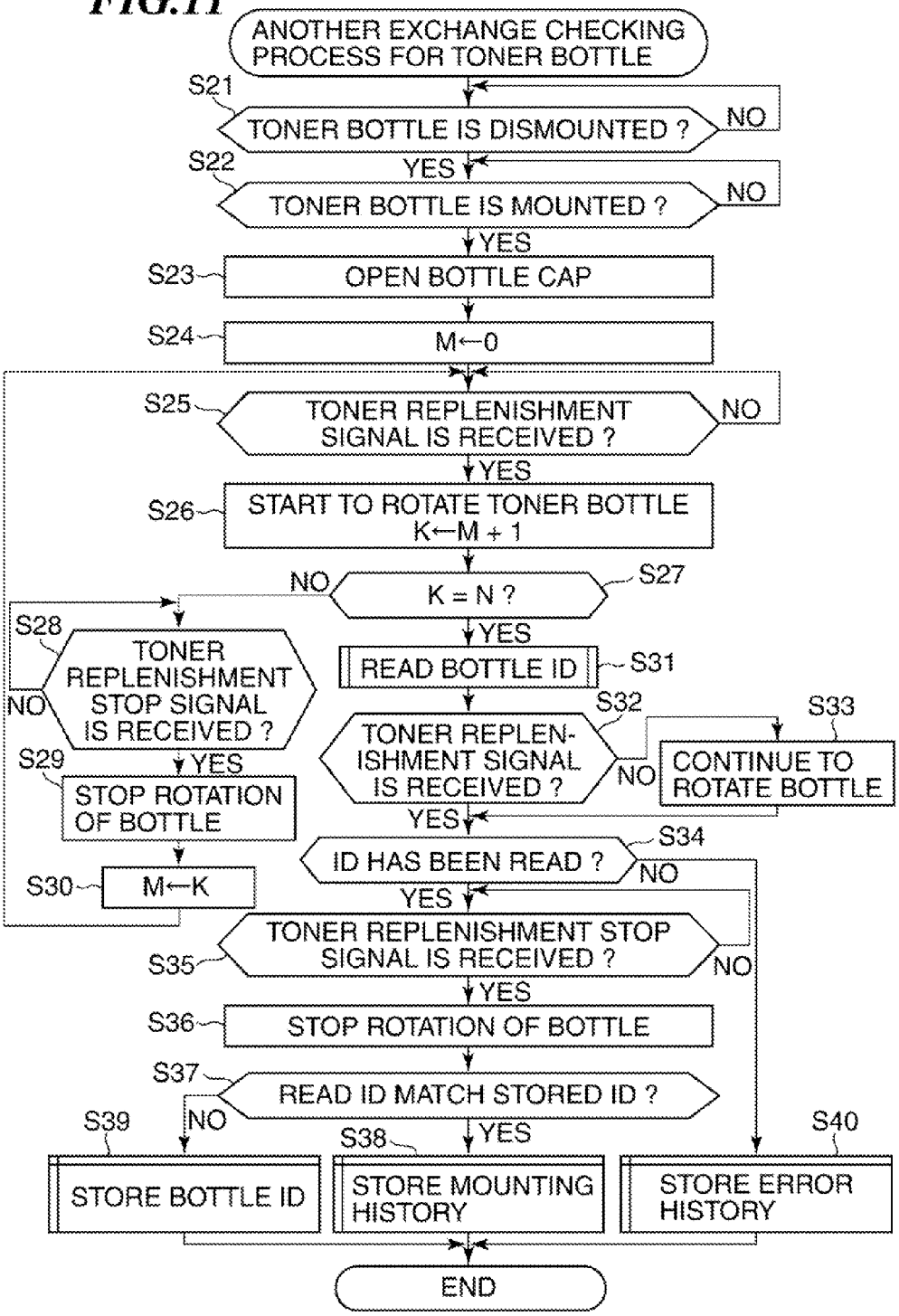
FIG. 11 is a flowchart showing an exchange checking process for a toner bottle in the image forming apparatus according to a second embodiment of the present invention.

Next, a second embodiment of the present invention will be described with reference to FIG. 11 through FIG. 13. The image forming apparatus according to the second embodiment is ready for the case where the amount of toner discharge from the toner bottle 3 does not satisfy the conditions Lrmax>Lr and Vrmax<Vs at worst unless the number of the replenishments becomes larger than a predetermined value.

Another exchange checking process for a toner bottle according to the second embodiment that is executed by the CPU 100 so as to supply toner continuously while exchanging a toner bottle will be described with reference to a flowchart in FIG. 11.

When the exchange checking process for a toner bottle is started, the CPU 100 waits until the toner bottle 3 is dismounted (NO in step S21). In the exchange checking process for a toner bottle, the CPU 100 detects that a user performs an operation according to the toner bottle exchange message displayed on the display unit 104. When the CPU 100 that detects the operation determines that the toner bottle 3 has been dismounted (YES in the step S21), the process proceeds to step S22.

The CPU 100 waits until the user mounts a toner bottle 3 (inserts to the mounting detection location) and the bottle mounting detection sensor 70 detects the mounting (NO in the step S22).

Next, when detecting the mount of the toner bottle 3, the bottle mounting detection sensor 70 transmits a bottle detection signal to the CPU 100. When receiving the bottle detection signal, the CPU 100 determines that the toner bottle 3 (YES in the step S22), and proceeds with the process to step S23.

Figure 2:
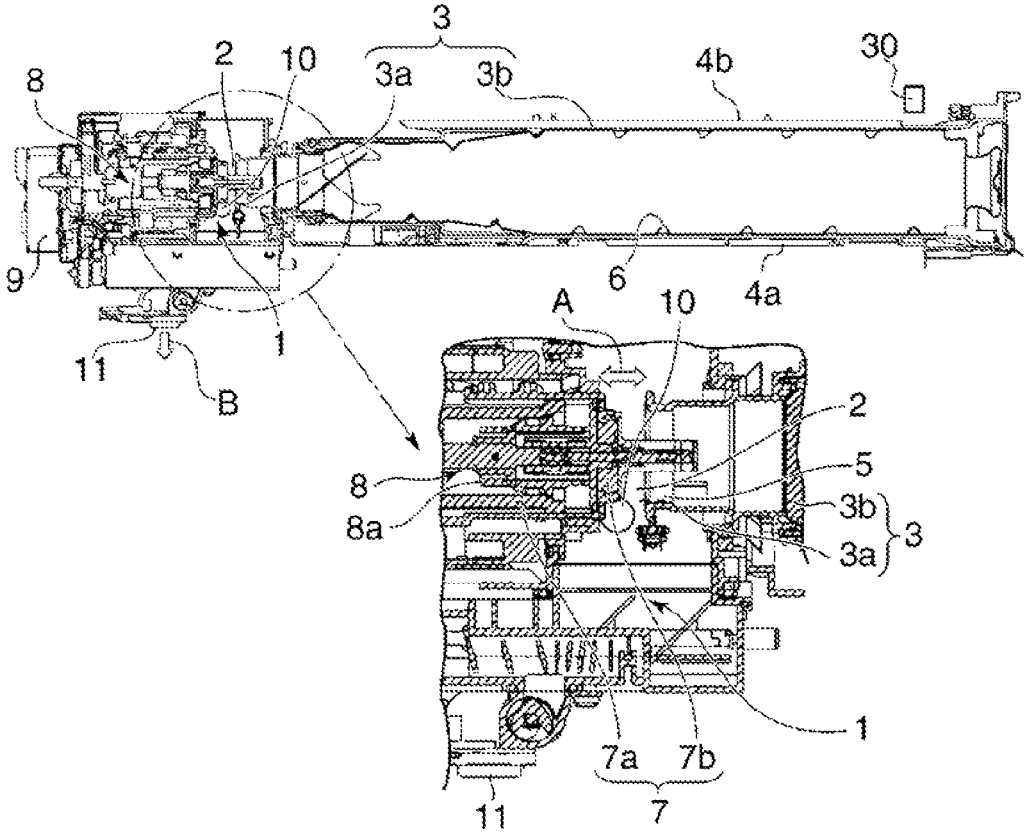
FIG. 2 is a sectional view showing a toner replenishment unit removed from the image forming apparatus according to the first embodiment and an enlarged sectional view showing a main part thereof.

Then, the CPU 100 drives the bottle drive motor 9 in the direction that moves the cap member 7 of the toner bottle 3 toward the open position shown in FIG. 2 (step S23). The rotation direction of the toner bottle 3 at the time is the first rotation direction that is opposite to a direction that rotates the toner bottle for supplying the toner. Then, the CPU 100 resets the count of receiving the toner replenishment signal (M←0) in step S24.

Furthermore, the CPU 100 waits until receiving the toner replenishment signal from the toner level sensor 10 (NO in step S25). When receiving the toner replenishment signal (YES in the step S25), the CPU 100 controls and drives the bottle drive motor 9 to rotate the toner bottle 3. Then, the rotation of the toner bottle 3 replenishes the toner accommodated therein to the toner replenishment unit 1 via the toner supply part 2. At this time, the CPU 100 calculates the history of the toner replenishment count K (K=M+1), and saves it into the RAM 102 (step S26).

Next, the CPU 100 determines whether the history of the toner replenishment count K matches the trigger count N for reading the unique ID. When they do not match (NO in the step S27), the CPU 100 proceeds with the process to step S28. Then, the CPU 100 rotates the toner bottle 3 to continue the toner supply until receiving the toner replenishment stop signal from the toner level sensor 10.

Next, the CPU 100 stops the rotation of the toner bottle 3 (step S29) when receiving the toner replenishment stop signal from the toner level sensor 10 (YES in the step S28). Then, the CPU 100 changes the count M of detecting the toner empty level by the history of the toner replenishment count K (step S30), returns the process to the step S25, and repeats the operations in the steps S26 and S27. When determining that the history of the toner replenishment count K matches the trigger count N for reading the unique ID (YES in the step S27), the CPU 100 proceeds with the process to step S31.

Next, the CPU 100 makes the ID pattern detection sensor 30 read a bar code of the barcode label 31 affixed on the outer circumferential surface of the toner bottle 3 (step S31). Then, the CPU 100 compares the detection result of the bar code by the ID pattern detection sensor 30 with bar pattern string conversion data that has been stored in the RAM 102 beforehand, and converts the bar code into the unique ID number of the toner bottle 3. It should be noted that the CPU 100 continues driving the bottle drive motor 9 to rotate the bottle (step S33), even if the toner replenishment signal is no longer received from the toner level sensor 10 while reading the unique ID (NO in the step S32).

Next, the CPU 100 determines whether the unique ID has been read after rotating the toner bottle 3 during predetermined time for reading the bar code (step S34). And when determining that the unique ID has been read (YES in the step S34), the CPU 100 proceeds with the process to step S35. Furthermore, the CPU 100 waits until receiving the toner replenishment stop signal from the toner level sensor 10 (NO in the step S35).

When receiving the toner replenishment stop signal from the toner level sensor 10 (YES in the step S35), the CPU 100 stops the bottle drive motor 9 (step S36) to stop the rotation of the bottle, and proceeds with the process to step S37.

Next, the CPU 100 determines whether the unique ID obtained in the step S31 matches an ID number that has been memorized in the nonvolatile memory 103 in the step S37. When determining to be matched (YES in the step S37), the CPU 100 proceeds with the process to step S38. When determining not to be matched (NO in the step S37), the CPU 100 proceeds with the process to step S39.

On the other hand, when determining that the unique ID has not been read due to a defect of the bar code etc. (NO in the step S34), the CPU 100 proceeds with the process to step S40. In the step S40, the CPU 100 stores an error history showing that the unique ID cannot be read and a mounting history (the number and date/time of bottle dismounting/mounting operations) to the nonvolatile memory 103, and finishes this process.

In the step 38, the CPU 100 specifies the data of the ID number that matches the unique ID read in the step S31 from among the ID numbers stored in the nonvolatile memory 103. Then, the CPU 100 overwrites only the mounting history (the number and date/time of bottle dismounting/mounting operations) on the data of the matched ID number, and finishes the exchange checking process for the toner bottle.

Moreover, the CPU 100 stores the unique ID read in the step S31 and the main body information associated with the unique ID to the nonvolatile memory 103 in the step S39, and finishes the exchange checking process for the toner bottle. It should be noted that the main body information includes toner color information, new reading time, a mounting history, a sheet number counter, a machine type, a machine number, and destination information.

Next, a condition that prevents over-supply of toner during the operation to read the unique ID of the toner bottle 3 in the image forming apparatus according to the second embodiment will be described with reference to FIG. 12 and FIG. 13.

Figure 12:
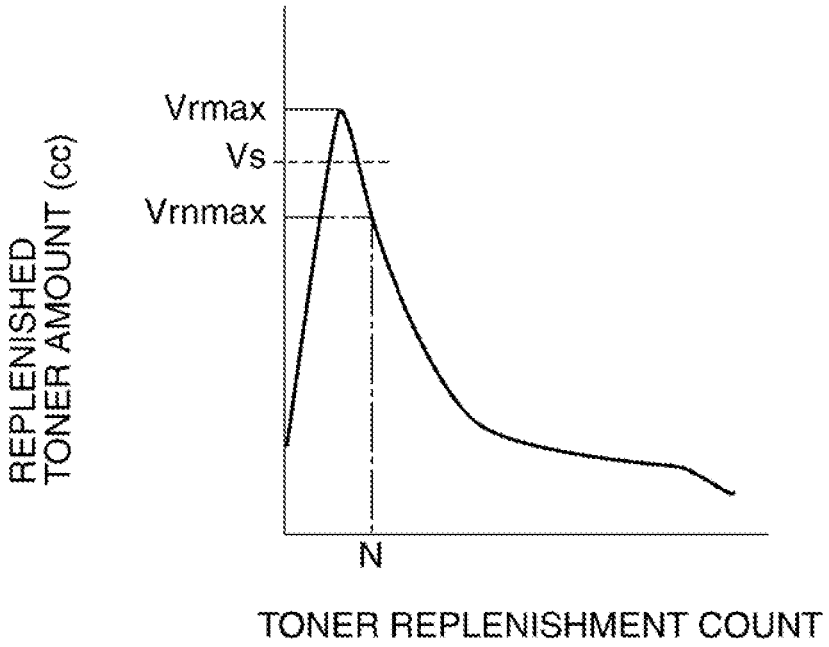
FIG. 12 is a graph showing an example of a state of the toner replenishing amount during the toner bottle detection control process in the image forming apparatus according to the second embodiment.

FIG. 12 is a graph showing an example of a state of the toner replenishing amount during the toner bottle detection control process according to the second embodiment. FIG. 13 is a schematic view showing a state of the amount of toner in the toner replenishment unit 1 of the image forming apparatus according to the second embodiment.

Figure 13:
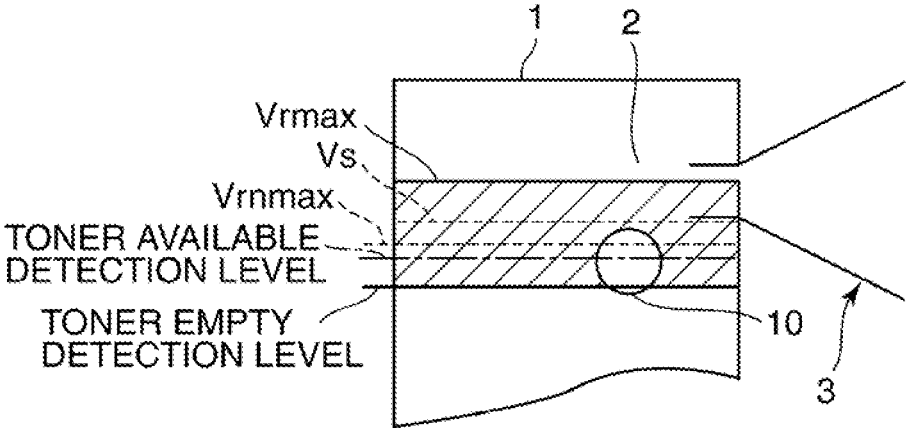
FIG. 13 is a schematic view showing a state of the amount of toner in the toner replenishment unit of the image forming apparatus according to the second embodiment.

In FIG. 12 and FIG. 13, "Vrmax" is the maximum toner replenishing amount corresponding to the maximum bottle rotation "Lrmax" for reading a bar code. Moreover, "Vrnmax" is a toner replenishing amount from the bottle when generating the toner replenishment signal in N-th time (the predetermined number of times). Furthermore, "Vs" is toner amount that can be accepted by the toner replenishment unit 1 when the toner replenishment signal is given.

In the image forming apparatus according to the second embodiment, the toner replenishment unit 1, the toner level sensor 10, and the length of the barcode label 31 are set up so that the toner replenishing amount from the toner bottle 3 becomes proper. Then, in the image forming apparatus according to the second embodiment, the toner replenishing amount from the toner bottle 3 is set up so as to satisfy the following conditional expressions at worst.

Lrmax>Lr and Vrmax>Vs Moreover, the apparatus is configured to read a bar code when the condition Vrnmax<Vs is satisfied at the time of the toner replenishment of the N-th time (the predetermined number of times) or later. Therefore, the ID pattern detection control for the toner bottle does not require changing the toner replenishment sequence. Here, the toner replenishment count set up so as not to overflow the toner is computed by making a graph showing the toner replenishing amount illustrated in FIG. 12 based on an experiment etc. The toner replenishment count N is computed corresponding to the value Vrnmax that is considered to be suitable on the graph. Moreover, the N-th time of the toner replenishment count when performing the bar code read operation may be arbitrarily set up within a range from the N-th time computed based on FIG. 12 to the time before the toner in the toner bottle 3 becomes empty.

Since the configurations, operations, and effects of the second embodiment other than described are similar to that of the first embodiment mentioned above, detailed descriptions thereof are omitted.

In short, in the image forming apparatus according to the second embodiment, the toner supply part 2 is arranged above the toner replenishment unit 1 that replenishes the toner to the development device. The toner supplying part 2 is equipped with the toner bottle 3 for supplying toner removably. The rotation of the toner bottle 3 conveys the toner accommodated in the bottle with a screw function of the spiral projected rims 6 formed on the inner circumferential surface of the toner bottle 3, and supplies the toner from the outlet 5 to the toner supplying part 2. Furthermore, the barcode label 31 is affixed at the specified position on the outer circumferential surface of the toner bottle 3.

Figure 7:
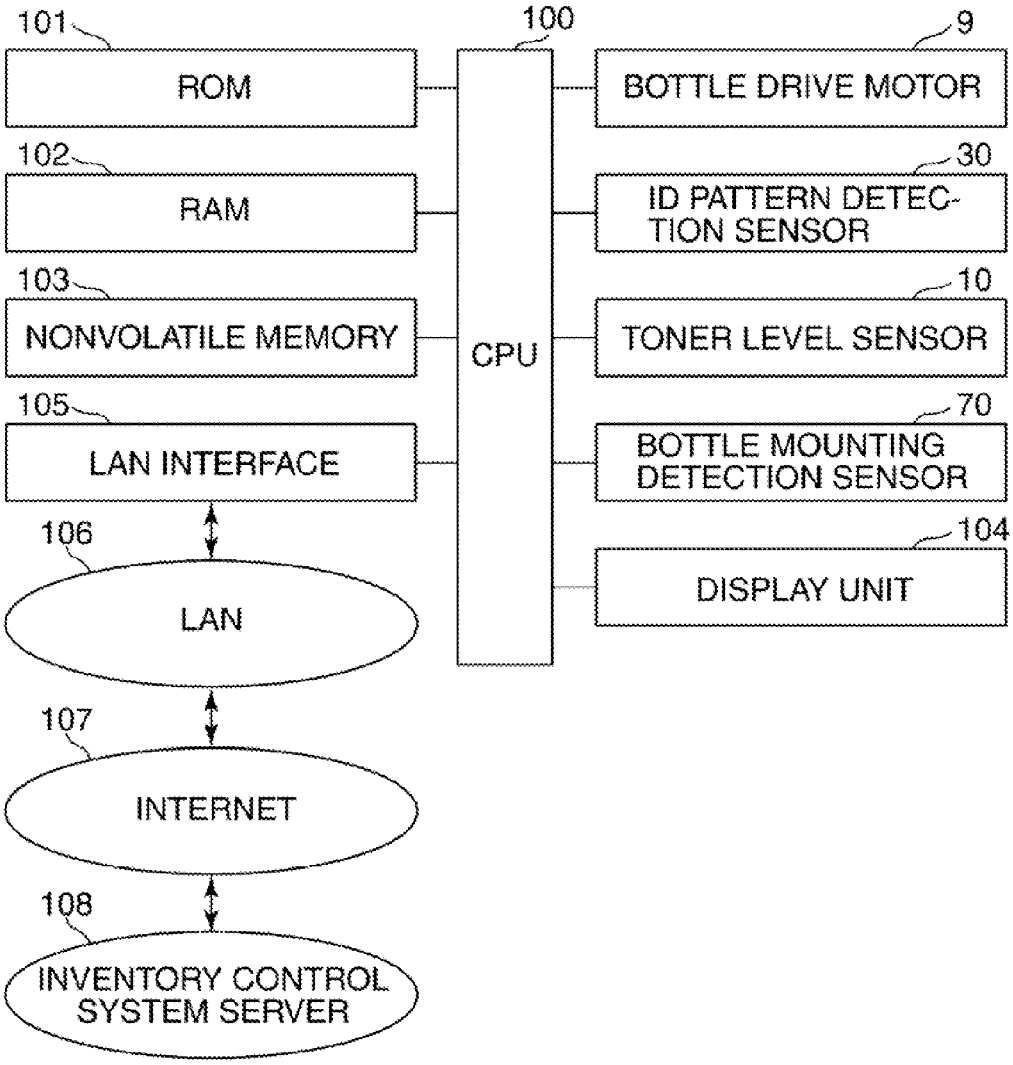
FIG. 7 is a block diagram schematically showing a control system of the image forming apparatus according to the first embodiment.

In the image forming apparatus, as shown in FIG. 7, the bottle drive motor 9, the toner level sensor 10, the ID pattern detection sensor 30, and the bottle mounting detection sensor 70 are connected to the CPU 100 as a control means.

Then, the image forming apparatus performs a toner supply control action under the control by the CPU 100 when the toner level sensor 10 detects the toner empty detection level that needs to supply toner.

In the toner supply control action, the CPU 100 controls the bottle drive motor 9 to rotate the toner bottle 3 in a predetermined period so that the necessary amount of toner is supplied to the toner supply part 2.

Moreover, in the toner supply control action, the toner replenishing amount from the toner bottle 3 varies in response to the count of the toner replenishment operations as shown in the graph in FIG. 9 or FIG. 12, for example. It should be noted that the data illustrated in the graph in FIG. 9 or FIG. 12 has been found by an experiment beforehand, and has been stored in a memory of the control means.

Moreover, the CPU 100 detects a mount of a new toner bottle 3 by the bottle mounting detection sensor 70, when the empty toner bottle 3 is exchanged for the new toner bottle in which the toner is filled.

The CPU 100 is constituted so that the unique ID cannot be read from the barcode label 31 of the toner bottle 3 by the ID pattern detection sensor 30 when the toner bottle 3 is rotated for supplying toner.

The CPU 100 has a function for transmitting information read from the barcode label 31 of the toner bottle 3 to the inventory control system server 108 through the Internet 107.

When the toner in the toner bottle is completely consumed, the user exchanges the empty toner bottle 3 for a new toner bottle 3. At this time, the bottle mounting detection sensor 70 detects the mount of the toner bottle 3, and transmits it to the CPU 100. Then, the image forming apparatus with the new toner bottle 3 is ready to perform the usual image forming operation. Thereby, the image forming apparatus performs the usual image forming operation until the toner level sensor 10 detects the toner empty detection level that needs to supply toner after exchanging for the new toner bottle 3.

The image forming apparatus replenishes toner and reads the unique ID after exchanging the toner bottle 3, when the CPU 100 receives the toner replenishment signal from the toner level sensor 10 that detects the toner empty detection level.

Here, the image forming apparatus sets up the timing to read the unique ID of the toner bottle 3 corresponding to configuration conditions.

For example, when the image forming apparatus is constituted so that the condition of Vrmax<Vs as shown in FIG. 9 always holds, the replenishment of toner and the reading of the unique ID are simultaneously performed when the first toner replenishment signal is given after exchanging the toner bottle 3.

However, even in such a case, the replenishment of toner and the reading of the unique ID may be simultaneously performed when the toner replenishment signal of the N-th time or later is given. It should be noted that the N-th time is directed to the same toner bottle 3 (the toner bottle of the same unique ID). Therefore, the count for the N-th time is reset when the certain toner bottle 3 is exchanged for another toner bottle 3.

Furthermore, "Vs" is toner amount that can be accepted by the toner replenishment unit 1 when the toner replenishment signal is given. Here, "Vrmax" is the maximum toner replenishing amount corresponding to the maximum bottle rotation "Lrmax" for reading a bar code.

Specifically, the maximum bottle rotation Lrmax for reading a bar code is measured from the position where the first bar of the barcode label 31 in the rotation direction for reading a bar code becomes impossible to read. Therefore, the maximum bottle rotation Lrmax for reading a bar code is equal to the sum of the one revolution of the toner bottle 3 and the bottle rotation from the position where the first bar becomes impossible to read to the position where the last bar is read.

The image forming apparatus in which the condition Vrmax<Vs holds performs the replenishment of toner and the reading of the unique ID simultaneously when the first toner replenishment signal is given after exchanging the toner bottle 3. In such an image forming apparatus, the toner does not overflow from the toner replenishment unit 1 even if the replenishment of toner and the reading of the unique ID are performed simultaneously. In addition, the image forming apparatus with this configuration may continue the toner replenishment operation until the amount of the replenished toner reaches the full amount of replenishment when the toner replenishment operation has not been completed at the time when the unique ID has been read.

The CPU 100 of the image forming apparatus with this configuration detects the toner empty detection level by the toner level sensor 10 at a certain timing after detecting the mount of the toner bottle by the bottle mounting detection sensor 70. At the certain timing, the CPU 100 starts the replenishment of toner and the reading of the unique ID simultaneously, and processes them in parallel.

Next, the case where the image forming apparatus may cause the condition of Vrmax>Vs as illustrated in FIG. 12 will be described. In this case, as mentioned above, the toner replenishing amount supplied from the toner bottle 3 varies in response to the count of the toner replenishment operations as shown in the graph in FIG. 12.

In the case shown by the graph in FIG. 12, the state where Vrmax exceeds Vs (Vrmax>Vs) and the state where Vs exceeds Vrnmax (Vrnmax<Vs) may occur. Here, "Vrnmax" is a toner replenishing amount from the bottle when generating the toner replenishment signal in N-th time.

Therefore, when the image forming apparatus is configured so that the condition of Vrmax>Vs may occur as shown in FIG. 12, the unique ID reading process is performed when the condition of Vrnmax<Vs is satisfied at the time of the toner replenishment of the N-th time or later. The toner replenishment count N at which the condition of Vrnmax<Vs holds has been found beforehand based on an experiment, and can be stored in the memory of the control unit.

That is, in the image forming apparatus that is configured so that the condition of Vrmax>Vs may occur, the CPU 100 performs the unique ID reading process after the toner replenishment at the N-th time after detecting a bottle mounting by the bottle mounting detection sensor 70. Accordingly, the image forming apparatus with this configuration performs only the toner replenishment process at the first timing when the toner level sensor 10 detects the toner empty detection level after detecting the mount of the bottle. From this timing, the image forming apparatus with this configuration counts times of the toner replenishments. When the count of the toner replenishments reaches N times, the CPU 100 starts the replenishment of toner and the reading of the unique ID simultaneously, and processes them in parallel. It should be noted that the replenishment of toner and the reading of the unique ID may be performed at an arbitrarily selected timing after the toner replenishment at the N-th time.

Moreover, in the image forming apparatus mentioned above, the CPU 100 transmits the unique ID read by the reading process of the exchanged toner bottle 3 to the inventory control system server 108 via the Internet 107.

As mentioned above, the image forming apparatus reads the unique ID of the exchanged toner bottle when the toner is consumed by the image formation process and is replenished. That is, the image forming apparatus reads the unique ID in conjunction with the toner replenishment action according to the toner replenishment sequence. Therefore, the image forming apparatus can start the image formation process immediately after exchanging the toner bottle by omitting an excessive action such as a reverse rotation of the toner bottle only for reading the unique ID after exchanging the toner bottle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1 Toner Replenishment Unit
2 Toner Supply Part
3 Toner Bottle
9 Bottle Drive Motor
10 Toner Level Sensor
12 Toner Replenishment Opening
30 ID Pattern Detection Sensor
31 Barcode Label
70 Bottle Mounting Detection Sensor
100 CPU

The invention claimed is:

1. An image forming apparatus comprising:

a toner replenishment unit to which a toner bottle containing toner is mounted detachably;

a bottle exchange detection unit configured to detect exchange of the toner bottle;

a rotational driving unit configured to rotate the toner bottle in order to replenish the toner into said toner replenishment unit;

a reading unit configured to read a unique pattern on the toner bottle during the rotation of the toner bottle;

a toner remaining amount detection unit configured to detect whether or not a toner remaining amount in said toner replenishment unit is smaller than a predetermined amount; and a control unit configured to, in a case where said toner remaining amount detection unit detects that the toner remaining amount is smaller than the predetermined amount, execute a replenishment process of controlling said rotational driving unit to rotate the toner bottle until said toner remaining amount detection unit detects that the toner remaining amount reaches the predetermined amount, and in a case where the number of the replenishment process being performed after the exchange of the toner bottle reaches a predetermined number of times, control said rotational driving unit to rotate the toner bottle and control said reading unit to read the unique pattern until a rotating time period of the toner bottle is longer than a predetermined time period of reading the unique pattern and said toner remaining amount detection unit detects that the toner remaining amount reaches the predetermined amount.

2. The image forming apparatus according to claim 1, wherein the unique pattern is a one-dimensional bar code, and said reading unit is a reflection type sensor that receives a light emitted from a built-in light emitting element and reflected by the bar cord pattern surface by a photo detector.

3. The image forming apparatus according to claim 1, wherein the predetermined amount is smaller than the maximum amount of the toner replenished from the toner bottle to the toner replenishing unit in a case where the toner bottle is rotated during the predetermined time period.

4. The image forming apparatus according to claim 1, wherein the unique pattern is attached onto an outer surface of the toner bottle.

* * * * *